US007213511B2

(12) United States Patent
Cruttenden et al.

(10) Patent No.: US 7,213,511 B2
(45) Date of Patent: May 8, 2007

(54) METHOD AND APPARATUS FOR PRINTING A RIBBON FOR PACKAGING GELATIN CAPSULES

(75) Inventors: Geoffrey J. Cruttenden, Swindon (GB); Neil J. Holland, Swindon (GB); George B. Tidy, Swindon (GB); Dennis Rowe, Swindon (GB)

(73) Assignee: R.P. Scherer Corporation, St. Petersburg, FL (US)

( * ) Notice: Subject to any disclaimer, the term of this patent is extended or adjusted under 35 U.S.C. 154(b) by 601 days.

(21) Appl. No.: 10/236,669

(22) Filed: Sep. 6, 2002

(65) Prior Publication Data

US 2003/0056667 A1 Mar. 27, 2003

Related U.S. Application Data

(62) Division of application No. 09/142,942, filed as application No. PCT/GB97/00780 on Mar. 20, 1997, now abandoned.

(30) Foreign Application Priority Data

Mar. 20, 1996 (GB) ..... 9605891.2

(51) Int. Cl.
*B41F 17/08* (2006.01)

(52) U.S. Cl. ..... 101/40; 101/35

(58) Field of Classification Search ..... 101/40, 101/35–37, 38.1, DIG. 36
See application file for complete search history.

(56) References Cited

U.S. PATENT DOCUMENTS 2,234,479 A 3/1941 Scherer ..... 167/83
3,333,031 A * 7/1967 Vincent, Jr. et al. ..... 264/15
3,374,303 A * 3/1968 Metz, Jr. ..... 264/216
3,592,372 A 7/1971 James et al. ..... 226/22
3,616,750 A 11/1971 Gottscho et al. ..... 101/157
3,712,215 A 1/1973 Cunningham ..... 101/219
3,732,663 A 5/1973 Geldmacher ..... 53/14

(Continued)

FOREIGN PATENT DOCUMENTS

DE 1 923 460 3/1970

(Continued)

*Primary Examiner*—Anthony H. Nguyen
(74) *Attorney, Agent, or Firm*—Donald D. Nickey

(57) ABSTRACT

Apparatus for producing image bearing filled gelatin capsules (12 and 16) for directing gelatin ribbon (2,4) from respective casting drums to an encapsulation station (6). Along the path of at least one ribbon (4) is a transfer station (18) at which images are applied to the ribbon. The images are applied in a pattern which corresponds to the pattern of capsules formed from the ribbon at the encapsulation station (6). Both the rollers (8) at the encapsulation station, and a support roller at or adjacent the transfer station are positively drive, and a control system ensures that the peripheral speed of a support roller (16) in the transfer station (18) is the same as the speed of the ribbon into and through the encapsulation station. The drive motor for the respective support roller in the transfer station is preferably a stepping motor, adjustable to advace or retard relative to the ribbon spped in the encapsulation station (6). Sensors (28, 64) may be included to postiviely monitor the alignment of ribbon with the encapsulation process. Provision is also made for monitoring the lateral positioning of images on the ribbon, and for shifting the ribbon to accommodate any lateral misalignment.

4 Claims, 5 Drawing Sheets

U.S. PATENT DOCUMENTS

| | | | | | |
|---|---|---|---|---|---|
| 4,090,432 | A | * | 5/1978 | Hobart | 493/20 |
| 4,206,965 | A | * | 6/1980 | McGrew | 359/9 |
| 4,225,251 | A | * | 9/1980 | Klimek et al. | 400/124.04 |
| 4,801,949 | A | * | 1/1989 | Misono et al. | 347/115 |
| 4,945,827 | A | | 8/1990 | Audi et al. | 101/35 |
| 5,103,617 | A | | 4/1992 | Sjogren et al. | 53/399 |
| 5,246,635 | A | * | 9/1993 | Ratko et al. | 264/4 |
| 5,735,105 | A | | 4/1998 | Stroud et al. | 53/411 |
| 5,761,886 | A | | 6/1998 | Parkhideh | 53/454 |

FOREIGN PATENT DOCUMENTS

| | | |
|---|---|---|
| DE | 2 016 799 | 2/1971 |
| DE | 27 06 671 | 8/1978 |
| GB | 920.004 | 3/1963 |

* cited by examiner

METHOD AND APPARATUS FOR PRINTING A RIBBON FOR PACKAGING GELATIN CAPSULES

RELATED APPLICATIONS

This application is a divisional application of U.S. patent application Ser. No. 09/142,942, filed Apr. 5, 1999 now abandoned, which is a 371 of International Application No. PCT/GB97/00780, filed Mar. 20, 1997 and claims priority to GB Application No. 9605891.2, filed Mar. 20, 1996.

TECHNICAL FIELD

This invention relates to the encapsulation of products within a gelatin shell derived from a ribbon thereof. The invention is concerned particularly with the printing of indicia on the gelatin ribbon such that the indicia appears in a predeterminable manner on the capsule products.

The encapsulation of a wide range of products in gelatin shells is long-established. The basic technique is described in U.S. Pat. No. 2,234,479, and it has of course been substantially developed since then. Nevertheless, modern encapsulation machinery still draws gelatin ribbon from two sources to a charging station where sections of gelatin strip from both ribbons are sealed around the respective contents. Encapsulation is normally accomplished using a flat or a roller die technique. A typical roller die technique is described in an article entitled "Soft gelatin capsules: a solution to many tableting problems" published in *Pharmaceutical Technology* in September 1985.

Gelatin capsules are normally made using soft gelatin and in its ribbon from prior to encapsulation it is highly flexible and deformable. Gelatin may be blended with other components to vary its characteristics in different ways for different applications. However, the term "gelatin" is used herein to encompass a range of gelatin based compositions which are used in encapsulation processes.

A problem that arises in the application of indicia to gelatin strips or ribbon is clarity of outline. The problem arises because of the inherent flexibility and elasticity of the gelatin, and also inconsistent metering of ink onto the printing roller. In known printing techniques this problem has been addressed by the use of printing rollers with roughened or screened surfaces, but while this has been effective when the image is being applied to paper or board for example, when used to deliver ink to gelatin unsatisfactory image outlines can be the result.

DE-A-2016799 discloses apparatus for marking indicia on continuous webs of thermoplastic packaging material such as polyethylene or a laminate formed from layers of polyethylene and aluminium foil or polyethylene, aluminium foil and paper. Such apparatus includes a rotating die wheel for applying the indicia to the web, and a rotating impression roller for pressingly engaging the web against the rotating die wheel. The die wheel extends into a well carrying ink so that ink is supplied to the die wheel. A doctor blade serves to remove excess ink from the die wheel which is of the gravure type wherein the printing means consists of recesses in the surface of the plate shaped as letters, numerals or other indicia and adapted to receive ink therein as they press through the bath of ink.

However, we have found that we can take advantage of the benefits derived from the use of a screened or roughened roller surface in the printing process if a roller with a screened surface is used as a transfer or inking roller carrying ink from a reservoir to the printing roller.

Thus, in accordance with the present invention, there is provided apparatus for producing image bearing filled gelatin capsules from gelatin ribbon, comprising an encapsulation station having formation and fill means; a guidance mechanism for feeding strips of gelatin ribbon into juxtaposition at the encapsulation station; a transfer station for applying a said image to at least one of the strips in the path of the ribbon to the encapsulation station, which transfer station has printing and support rollers on either side of the path of the strip; an inking roller in rolling engagement with the printing roller and for drawing ink thereonto from a reservoir, which inking roller has a screened surface; and means for wiping the inking roller surface prior to its engagement with the printing roller.

With ink from the reservoir being retained in rather than on the screened surface, the inking roller surface can be wiped, preferably with a doctor blade, prior to its engagement with the printing roller while still bearing sufficient ink for transfer to the printing roller and subsequent application to the gelatin ribbon strip. This technique results in consistent and predictable quantities of ink being transferred from the inking roller to the printing roller, and assists in preserving sharp image outlines on the printing roller.

Rollers with screened or roughened surfaces are available in the United Kingdom under the registered Trade Mark ANILOX™ from Sun Chemical Limited of Watford, Hertfordshire. The surface of these rollers is chrome hardened, and rollers can be provided with different degrees of screening or roughening. The roller surface is formed with a tight array of pockets, typically 100, 150 or 200 lines per inch (equivalent to 10,000; 22,500; or 40,000 pockets per square inch—1 inch=2.54 cm), with the largest pockets (10,000 per square inch) having the greatest depth. The array may comprise at least 100 lines per inch (40/cm), each having a minimum depth of 25 μm and preferably having a depth of 50 μm. It will be appreciated that by wiping or scraping the inking roller surface, ink is retained in the pockets and is readily transferred therefrom to the printing roller. The required degree of screening or roughening is normally determined relative to the ink and the colour of the ink that is being printed.

Rollers of the kind described above are particularly suited for use in flexographic printing systems which are particularly preferred in the present invention. In flexographic printing systems, ink is carried from a reservoir via a fountain roller and a transfer roller to a printing roller which is applied to the substrate upon which the image is to be printed. The transfer roller has the screened or roughened surface and provides a means for accurately controlling the amount of ink carried to the printing roller. Flexographic printing systems have been used for printing into a wide range of substrates, and could be operated at very high speeds. Roller speeds in excess of 100 rpm were common. In the practice of the present invention, the speed of the printing process is dramatically less than that normally used in Flexographic systems, with the gelatin ribbon strip moving typically at a speed of around 2.5 cm per second, equivalent to a printing roller speed at around 3 rpm. With these relatively low speeds, there is a risk of ink drying on the rollers, and particular care has to be taken to avoid or at least minimise this eventually. Self-cleaning transfer and printing rollers are available and additionally, particular care can be taken in selecting appropriate inks. Suitable inks for use in the present invention are available under the names OPACODE from Colorcon Limited of Orpington, Kent, England; and MASTERCOTE from Warner Jenkinson of Kings Lynn, Norfolk, England. In addition to selecting a suitable ink, in the practice of the present invention the risk of drying ink is further reduced by removing the fountain roller from the traditional sequence in a flexographic printing system, and having the transfer roller receive ink direct from the reservoir tray.

Because of its flexibility and deformability, while various methods have been proposed for applying markings to gelatin ribbon which appear on the resulting capsule, it has not been possible to accurately locate specific indicia on a gelatin ribbon such that the indicia appear in a predeterminable manner on the resultant capsules.

Pursuant to the above, apparatus of the present invention may further include a motor for driving at least one of the support rollers, and a control system for monitoring the speed of the strip into the encapsulation station, and driving at least one support roller at a peripheral speed equal thereto. The ribbon is positively driven into and through the encapsulation station, and positive driving of the support roller or rollers is necessary if the images or indicia to be applied are to be in proper register, in order to take account of stretching or other distortion of the gelatin ribbon.

The drive motor for the respective support roller in the transfer station is preferably a stepping motor, which can be adjusted to advance or retard relative to the ribbon speed at the encapsulation station. The control system can be used to directly monitor the position of images on the strip in its direction of travel as it enters the encapsulation station, or the position of the formation means in the encapsulation station, and to adjust the drive motor accordingly, to maintain a predetermined position of the images or indicia in the encapsulation station. Suitable stepping motors and control systems are available from Simplatroll Limited of Bedford, England.

The control system can be used to ensure that once the print system is set up, any change in machine speed will automatically lead to adjustment such that the printing roller runs at the same speed. The initial set-up is by using a small micro-processor/programme to adjust the vertical alignment in very small increments of for example 0.25 mm, to allow print to be centralised on the dies at the encapsulation station. The positioning of the printing roller with the dies can be indexed by picking up a signal from a fixed point on the dies and a fixed point on the printing roller to continually monitor their positions.

The nature of gelatin, particularly in ribbon form, is such that it can easily shift laterally on guide rollers, and the invention also provides for such lateral shift to be corrected. This can be accomplished by enabling lateral movement of one or more support rollers relative to the path of the strip to correct any misalignment of the applied images or indicia in the encapsulation station. Using an alternative technique, this is achieved using an applicator guide assembly including a guide roller; sensing means for monitoring lateral movement of the imaged strip on the guide roller; a locator roller mounted for rotation about a pivotal axis; and means for pivoting the locator roller relative to the guide roller to shift strip laterally thereon. The strip will normally pass between the guide and locator rollers. In the lateral shifting or correction of the strip, flexibility and deformability of the gelatin is of considerable assistance as it enables this lateral adjustment to be accomplished without difficulty and more importantly, without shutting down the apparatus itself.

In another preferred feature of the invention, the support roller is mounted for rotation on a fixed axis and the printing roller is mounted for rotation about an axis movable towards and away from the support roller axis. This enables the pressure between the rollers to be controlled and more importantly to be maintained substantially constant to ensure consistent print quality on the gelatin ribbon. A constant force can typically be provided by an air pressure mechanism. Various different mechanisms can be used to provide for adjusting the force and different pressures may be developed along the length of the rollers if for some reason this was desired. Similarly, the colour and/or nature of the ink or inks used can be varied, enabling the generation of ornamental patterns of different colours on the encapsulated product.

DESCRIPTION OF THE DRAWINGS

The invention will now be described by way of example, and with reference to the accompanying schematic drawings wherein.

DETAILED DESCRIPTION OF PREFERRED EMBODIMENTS

Figure 1:
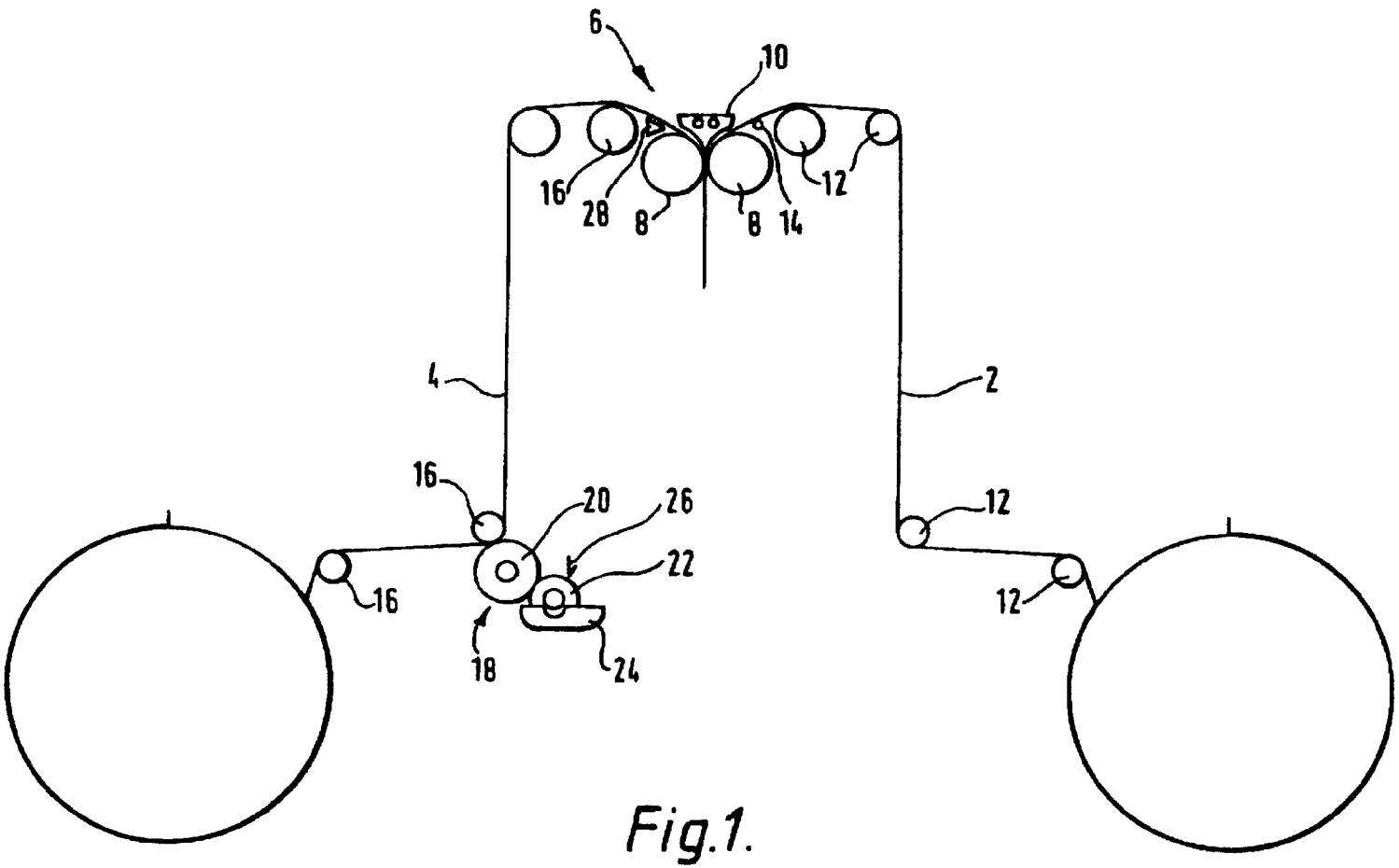
FIG. 1 is a representation of apparatus according to the invention.

The apparatus diagrammatically illustrated in FIG. 1 shows the path of two gelatin ribbons 2, 4 from respective casting drums to an encapsulation station 6 comprising roller dies 8 which combine with a fill mechanism (not shown) coupled to a wedge 10 to encapsulate fill material in a conventional manner. The ribbon 2 is carried to the encapsulation station 6 around rollers 12 and over a feed bar 14. The path of ribbon 4 is around rollers 6, and a sensing device 28. One of the rollers 16 is part of a transfer station 18 at which images are applied thereto from printing roller 20. Ink is applied to the printing roller 20 from transfer or inking roller 22 disposed over ink bath 24.

The roller dies 8 at the encapsulation station 6 are formed with recesses which are in juxtaposition when they reach the nip and are filled. In order to properly locate images applied to the ribbon 4 on formed capsules, it is of course essential that the applied images properly register with the recesses.

The inking roller 22 has a screened or roughened surface comprising an array of pockets. A roller having a particular pocket density on its screened surface will be selected depending upon the ink that is being used and the required printing effect. As a general guide, larger pockets will be used for lighter colours where a greater quantity of ink must be transferred to ensure that the requisite image is created on the ribbon surface. Because of the retention of the ink in rather than on the surface of the inking roller 22, its surface can be scraped or wiped at the pocket peripheries with the retained ink being a predictable metered quantity. This enables the density of colour in the printed image to be accurately established, and by this means, a reliable quality of printing can be achieved.

As can be seen, the gelatin ribbon 4 bearing images transferred thereto from printing roller 20 is carried around to the encapsulation station 6 where the device 28 monitors the location of images on the ribbon relative to the recesses in the roller die 8 in which the capsules will be formed. The device 28 is located such that the ribbon section and roller die section that it scans are equidistant from the roller nip. Thus, it can immediately establish whether a printed image is in proper registry with a respective recess and if not, what correction is required. Signals generated by the scanning device 28 are transmitted to a control device (not shown) which adjusts the speed of the printing roller 20 as appropriate.

Figure 2:
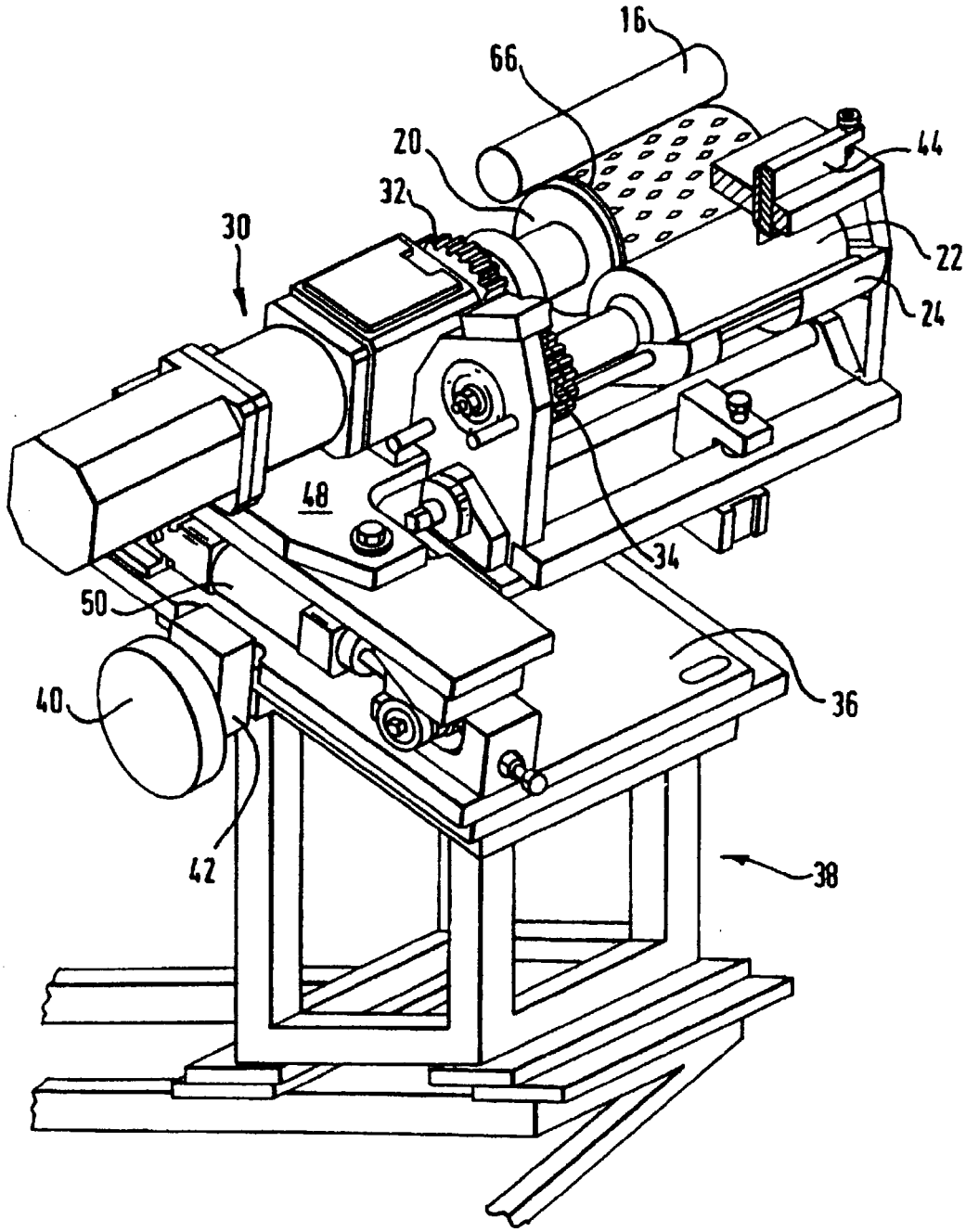
FIG. 2 is a perspective view showing a transfer station of the kind used in the apparatus of FIG. 1.

The transfer station 18 is illustrated in more detail in FIG. 2. The printing roller 20 is driven by a stepping motor 30. The shaft coupling the roller 20 to the motor 30 bears a gear wheel 32 which meshes with another wheel 34 which drives the inking roller 22. An encoder (not shown), typically mounted on one of the rollers 8 in the encapsulation station, monitors the rotation of the rollers and thereby the location of the recesses in the rollers 8 in the nip. The encoder is coupled to the stepping motor 30 which is thereby synchronised with the motor driving the roller dies 8. However, in the event that for some reason this synchronism is lost, the incorrect lengthwise alignment of images printed on the ribbon 4 with the recesses in the roller dies 8 is sensed by the device 28, and the stepping motor is automatically adjusted appropriately to bring them back into synchronism.

The entire transfer station is mounted on a plate 36 which is itself movably mounted on a printer generally indicated 38. When the encapsulating apparatus is initially assembled, the lateral location of the printing roller 20 relative to the adjacent guide roller 16 and hence the ribbon 4 is set by adjustment of wheel 40. Wheel 40 is part of a worm gear mechanism which locates the plate 36 relative to the printer 38, which mechanism also includes a gear box 42. The gear box 42 has its own drive, also adapted to receive signals from the scanning device 28 such that once the encapsulating apparatus is in operation, lateral misalignment of images on the ribbon fall as monitored by the device 28 is compensated. In this respect it should be noted that the lateral shift of the printing roller 20 relative to the guide roller 16 will eventually shift the printed images relative to the ribbon 4. The flexibility of the ribbon 4, to which reference is made above, enables such movements to be readily accommodated.

The inking roller 22 is a screened roller, and functions in known manner to transfer ink from the ink bath 24 to the printing roller 20. A doctor blade 44 is used to wipe the screened surface of the inking roller 22 as described above.

The printing roller 20; inking roller 22 and ink bath 24, together with the relevant drive units 30, 32 and 34, are mounted on a common plate 48 which is itself mounted on plate 36 for lateral movement relative to the respective roller axis towards and away from the guide roller 16. A pneumatic cylinder 50 applies a continuous pressure urging the plate 48, and hence the printing roller 20, towards the guide roller 16 and thus determines the pressure at which the printing roller 20 engages the gelatin ribbon 4.

Provision is also made in the apparatus illustrated in FIG. 2 for adjusting the alignment of the printing roller 20 and the inking roller 22 to achieve differential inking weights across the axial length thereof. Further, provision may also be made for deliberately inclining the axis of the printing roller 20 to the axis of the guide roller 16 to obtain a differential printing pressure on the ribbon along a transverse section thereof. These features can be of value when using different inks for images to be created along a transverse section of ribbon 4.

Figure 3:
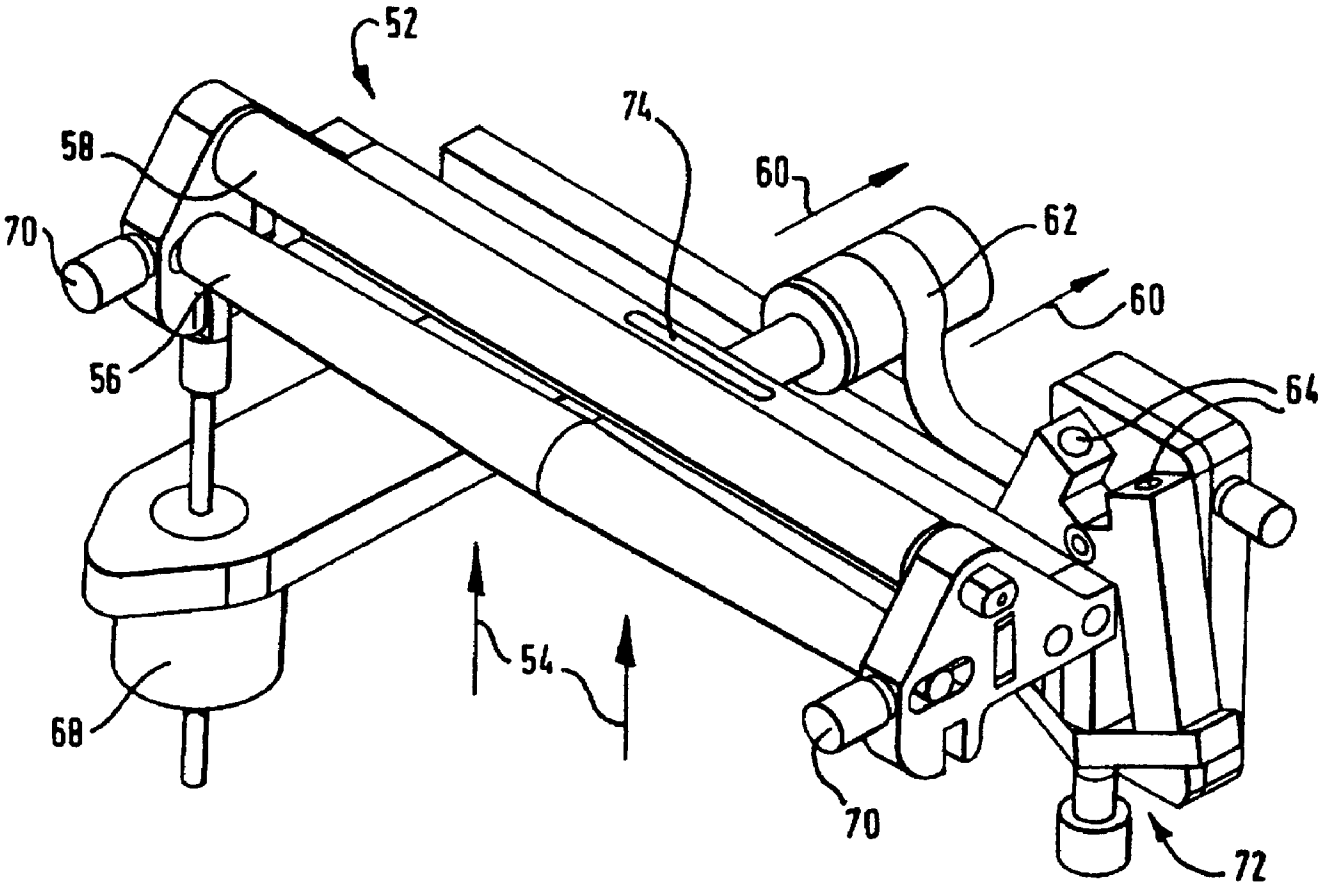
FIG. 3 is a perspective view of an alternative monitoring system for the gelatin ribbon.

An alternative system for monitoring and controlling the registry of the printed images with the rollers 8 in the encapsulation station is shown in FIG. 3. An applicator guide bar assembly 52 adjusts and sets the lateral alignment of the ribbon prior to its entry into the encapsulation station 6. It can effectively replace not only the sensing device 28, but also one of the rollers 16. The path of the ribbon (not shown in FIG. 3) is upwards as indicated by arrows 54 between front guide 56 and sparge tube 58 mounted on the assembly frame.

From the sparge tube 58 the ribbon passes as indicated by arrows 60 over bracket 62 to the final guide roller 16 and thence to the encapsulation station 6. A marginal edge portion of the ribbon passes over two optic sensors 64 which can monitor the position of either the edge of the ribbon, or a marker line thereon applied by a ridge 66 on the printing roller 20 at a transfer station. Any lateral movement of the edge or the market line beyond a predetermined limit is sensed, and in respect thereto the axis of the front guide is re-oriented by instruction from a computer (not shown) to guide the edge or marker line back into place. The primary mechanism for accomplishing this is a linear actuator motor 68, adapted to raise or lower one end of the front guide relative to the sparge tube. The guide bar assembly also includes adjusters 70 for initial setting of the front guide when the apparatus is first installed. The optic sensors 64 can themselves be adjusted, both translationally together across the frame, and relative to each other by a mechanism 32 for different ribbon sizes and required accuracy of lateral alignment. The assembly 52 also carries an optic sensor 74 on the frame for monitoring the longitudinal registry of the printed images with the rollers 8 in the encapsulation station 6. Signals for sensor 74 are likewise transmitted to the computer which in turn instructs the stepping motor 30 as required.

Figure 4:
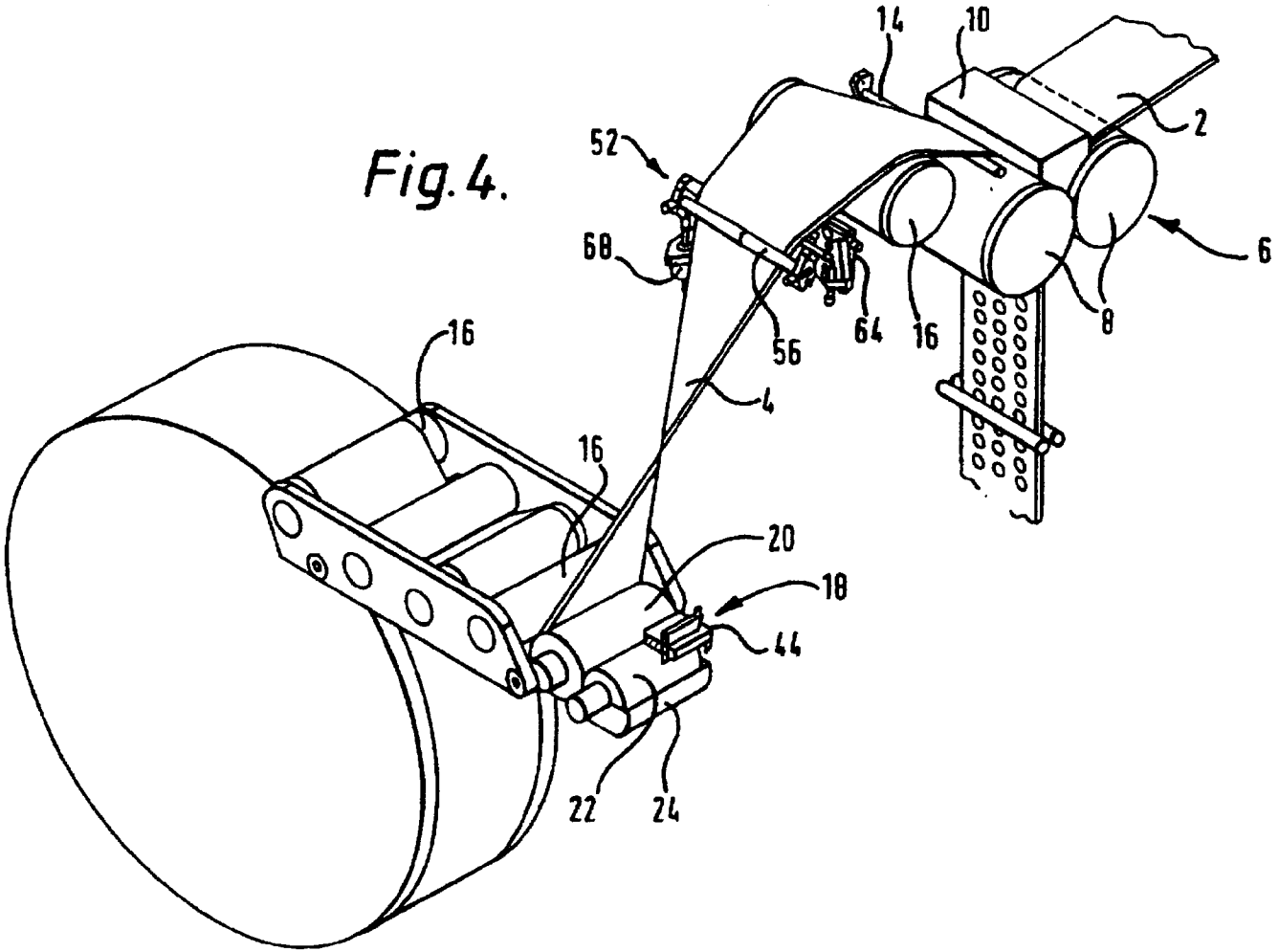
FIG. 4 illustrates apparatus according to the invention which requires the ribbon to twist in its path to the encapsulation station.
Figure 5:
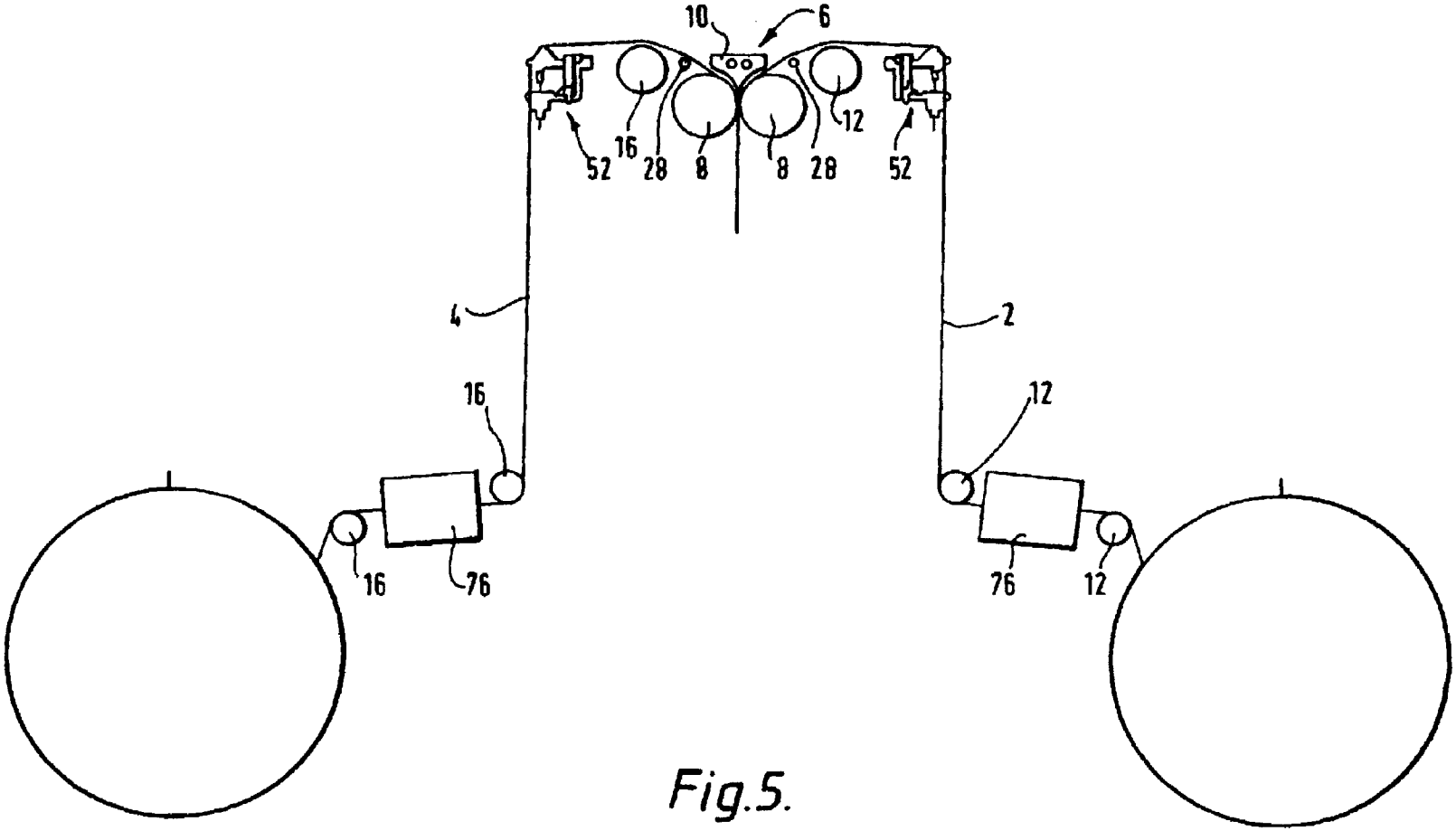
FIG. 5 is a representation of another embodiment of apparatus according to the invention.

For reasons of space, the layout of the elements in a gelatin encapsulating machine would not in practice normally be that shown in FIG. 1. Most significantly, the gelatin casting drums would be turned through 90° to be aligned on substantially the same axis perpendicular to the axes of the rollers 8 in the encapsulation station. This arrangement is illustrated in FIG. 4 which shows the path of ribbon 4, to which images are applied, in apparatus which is fitted with an applicator guide bar assembly 52 of the kind shown in FIG. 3 in place of one of the rollers 16 of FIG. 1. FIG. 4 also shows the train of smoothing and stretching rollers in the path of ribbon from the casting drum to the transfer station 18. As can be seen, the arrangement shown requires the ribbon to twist between the transfer station 18 and the applicator guide bar assembly, which itself increases the importance of monitoring any movement of the imaged ribbon out of registry with the rollers in the encapsulation station, particularly lateral movement.

The path of ribbon 2 from its casting drum to the encapsulation station 6 is essentially a mirror image of that shown in FIG. 4, but omitting the transfer station 18. An applicator guide bar assembly can be included, particularly to monitor lateral movements on the ribbon 2. For the unmarked ribbon of course, the sensors 64 will monitor the position of the ribbon edge only. Longitudinal registry of the ribbon 2 with the encapsulation station does not normally require monitoring.

INDUSTRIAL APPLICABILITY

The present inventive method provides for producing image bearing filled soft capsules. The method employs an apparatus that uses guide rollers for directing ribbon from casting drums to an encapsulation station through a transfer station where the images are applied. Various methods and apparatuses have been used for applying indicia to filled soft capsules, however, accurately locating specific indicia on a gelatin ribbon in a predeterminable manner has eluded the industry process. The apparatus and process according to the present invention provides a significant advance in the state of the art.

In the foregoing, there is provided a detailed description of preferred embodiments of the present invention for the purpose of illustration and not limitation. It is to be understood that other modifications, alternations and equivalents obvious to those having skill in the art based on this disclosure are intended to be within the scope of the invention as claimed.

We claim:

1. A method of producing filled soft capsules comprising: feeding film into juxtaposition at an encapsulation station (6) having formation and fill means, the improvement characterized by the steps of:

(a) applying images to at least one of the films (2, 4) at a transfer station (18) comprising a print roller (20), an inking roller (22), a support roller (16), and a stepping motor (30) for driving the print roller (20); and a guide bar assembly, said guide bar assembly (52) comprising sensing means (64) for monitoring lateral movement of said film, and a locator roller (56) mounted for rotation above a pivotal axis to shift said film laterally; and (b) adjusting the speed of the film (2, 4) in the transfer station (18) to correct any error in the longitudinal position of images on the film (2, 4) in the encapsulation station (6).

2. The method according to claim 1, additionally Including the step of monitoring the lateral alignment of images on the film (2, 4) in the encapsulation station (6) and shifting the film transversely to correct any misalignment.

3. The method according to claim 2 wherein the lateral alignment of the film (2, 4) is monitored by observing an edge of the film or a line applied to the film adjacent to said edge.

4. The method according to claim 3 wherein said line is applied at the transfer station (18).

* * * * *